US005453756A

United States Patent [19]

Lowrey

[11] Patent Number: 5,453,756

[45] Date of Patent: Sep. 26, 1995

[54] ANTENNA MOUNTING APPARATUS

[76] Inventor: Larry Lowrey, R.R. 1, Box 116, Malcolm, Nebr. 68402

[21] Appl. No.: 183,884

[22] Filed: Jan. 21, 1994

[51] Int. Cl.[6] ..... H01Q 1/12

[52] U.S. Cl. ..... 343/892; 343/715; 343/878; 248/539

[58] Field of Search ..... 343/878, 715, 343/709, 713, 879, 882, 906, 892, 888; 248/539, 540, 541; 439/916; H01Q 1/12

[56] References Cited

U.S. PATENT DOCUMENTS

| | | | |
|---|---|---|---|
| 2,203,986 | 6/1940 | Farwell | 343/892 |
| 2,269,947 | 1/1942 | Ludwig | 343/892 |
| 3,346,863 | 10/1967 | Siebold | 343/892 |
| 3,943,524 | 3/1976 | Sample | 343/892 |
| 3,967,275 | 6/1976 | Wagman | 343/713 |

*Primary Examiner*—Donald Hajec

*Assistant Examiner*—Hoanganh Le

*Attorney, Agent, or Firm*—John A. Beehner

[57] ABSTRACT

The present invention includes an improved antenna mounting apparatus for mounting a conventional antenna to a mounting structure. The antenna mounting apparatus including a pair of vertically spaced apart arms having aligned holes therethrough and a base connected to and extending between the arms. A mounting device for mounting the bracket to the mounting structure is provided with two O-ring shaped insulating members each adapted to be received in a respective one of the aligned holes in the arms; antenna connection device adapted to engage the antenna and secure the antenna to one of the spaced apart arms. A cable connection device is provided for connecting an electrical cable to the apparatus. Interconnection device are adapted to engage the antenna connection device and the cable connection device such that the antenna connection device, the interconnection device and the cable connection device all form a single structural unit extended through the aligned holes of the mounting bracket arms.

12 Claims, 4 Drawing Sheets

ANTENNA MOUNTING APPARATUS

BACKGROUND OF THE INVENTION

1. Technical Field

The apparatus of the present invention relates generally to devices for mounting antennas to mobile vehicles and the like. More specifically, it relates to an antenna mounting apparatus wherein a plurality of support arms in cooperation with mounting brackets are provided for mounting and supporting the antenna when the antenna is mounted on a mobile vehicle or the like.

Antennas for radio equipment such as conventional Citizen Band radios, Amateur (ham) radios and the like are frequently mounted externally on vehicles. One frequent use of such external antennas is by over-the-road truck drivers. In such situations, the antenna is typically mounted to an existing structure such as a mirror mounting.

A plurality of embodiments is provided wherein the improved antenna mounting apparatus disclosed herein may be secured to an existing external mounting member such as mirror mounts and the like. Additional support is provided for the antenna by the plurality of support arms. The improved mounting apparatus will accommodate a variety of antenna cable connection means such as conventional coax cable connector or simple wire termination.

2. Description of the Prior Art

Mobile radios are used in a variety of circumstances. One of the most common is their use in mobile vehicles such as cars, trucks, boats, and even farm vehicles. In such environments it is desirable that the antenna be mounted external to the vehicle so that the maximum amount of radio frequency (RF) energy is radiated from the transmitter and to distant receivers. To facilitate the external mounting of such antennas to mobile vehicles, a number of mounts have been designed and marketed.

Currently, antenna mounts for mobile vehicles and the like generally comprise two parts. First, a means for securing the mounting to an existing external structure of the mobile vehicle and, second, a mounting support arm upon which the antenna is mounted. In this conventional configuration, the antenna mounting is specially prone to stability problems caused by antenna contact with overhead obstacles such as tree branches or the like. Providing the dual mounting bracket of the present invention greatly enhances antenna mounting stability by providing an additional leveraging point to stabilize any antenna movement.

Numerous prior art antenna mounts are in existence, the majority of which embody the aforementioned single bracket construction. An example of such construction is illustrated in Wagman, U.S. Pat. No. 3,967,275 wherein the inventor provides a clamp type mounting adapted to be mounted on an outwardly extending rodlike member such as a rear view mirror supporting arm. Since the antenna mounting apparatus of Wagman provides a single mounting and leverage point, it suffers from the aforementioned stability problems of the antenna mountings utilizing a single bracket.

Therefore, a primary objective of the present invention is to provide an antenna mounting apparatus and method providing additional stability for antennas mounted to motorized vehicles and the like, thereby limiting the antenna's susceptibility to vibration.

A further objective is to provide an antenna mounting apparatus having increased strength and resistance to damage from impact with tree branches and the like.

A further object of the invention is to provide an antenna mounting apparatus and method capable of utilizing a variety of cable connection means.

A further object of the present invention is to provide an antenna mounting apparatus and method having a variety of mounting bracket spacings thereby providing a variety of stability configurations.

A further objective is to provide an antenna mounting apparatus capable of alternative antenna mounting positions such as on either the upper or lower support arms.

A final objective is to provide an antenna mounting which can be used with conventional antenna configurations.

SUMMARY OF THE INVENTION

The present invention includes an improved antenna mounting apparatus for mounting a conventional external antenna to a mounting structure. The antenna mounting apparatus includes a pair of vertically spaced apart arms having aligned holes therethrough and a base connected to and extending between the arms. A mounting means is used for mounting said bracket to said mounting structure. Two O-ring shaped insulating members are provided with each adapted to be received in a respective one of said aligned holes in the arms. An antenna connection means is adapted to engage the antenna and secure the antenna to one of the spaced apart arms. A cable connection means is provided for connecting an electrical cable to the antenna mounting apparatus. Interconnection means are adapted to engage the antenna connection means and the cable connection means such that the antenna connection means, interconnection means, and cable connection means all form a single structural unit extended through said aligned holes of the mounting bracket arms.

DESCRIPTION OF THE PREFERRED EMBODIMENT

Figure 1:
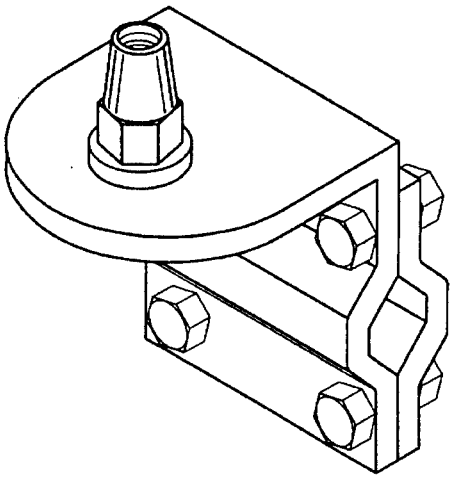
FIG. 1 PRIOR ART
FIG. 1 is a perspective view of the prior art antenna mount.
Figure 2:
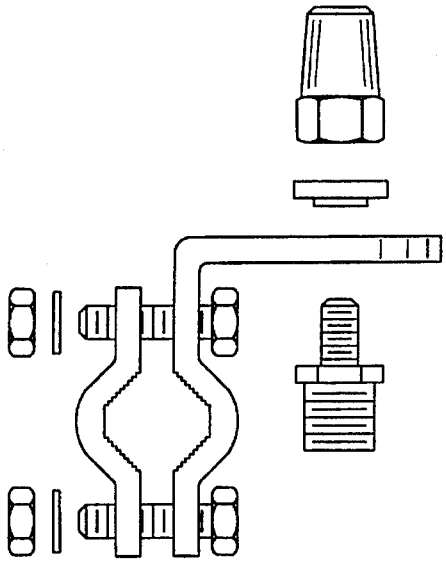
FIG. 2 PRIOR ART
FIG. 2 is an exploded view of the prior art antenna mount.
Figure 3:
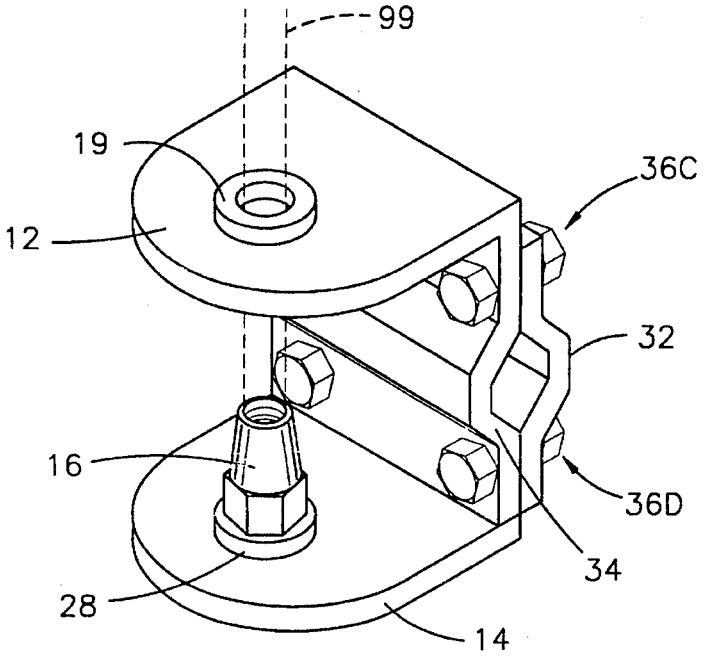
FIG. 3 is a perspective view of an embodiment wherein the antenna is mounted on the lower bracket and the upper bracket serves as a guide sleeve for the antenna.
Figure 4:
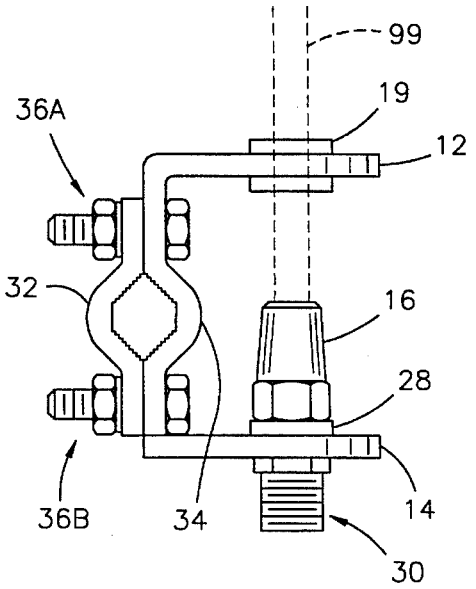
FIG. 4 is a side view of the embodiment of FIG. 3.
Figure 5:
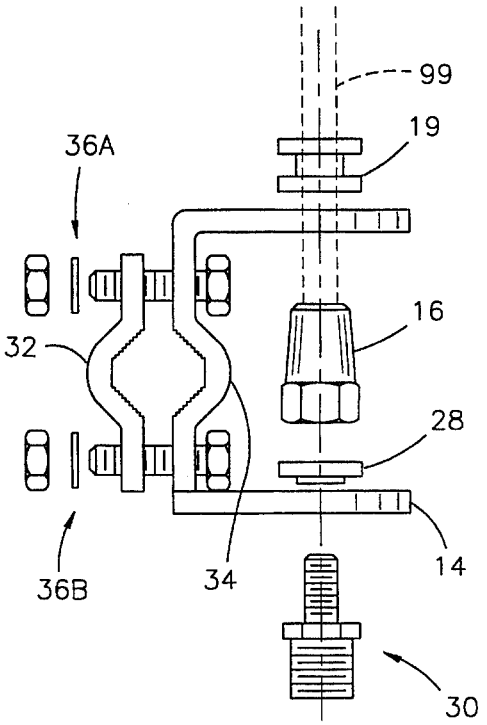
FIG. 5 is an exploded view of the embodiment of FIG. 4.

The preferred embodiment of the present invention is best illustrated in FIGS. 3–5. In this embodiment, antenna connection means 16 is secured to the lower arm 14 with the upper arm 12 and associated insulating member 19 acting as a guide sleeve. As shown in the figure, antenna connection means 16 is electrically insulated from lower support arm 14 by means of insulating member 28. In the preferred embodiment, connection means 16 is a conventional housing adapted to threadably receive antenna 99 on one end and to threadably receive cable connector means 30 on the opposite end. Threaded engagement of coaxial cable connector means 30 and antenna connection means 16 cause antenna connection means 16 and coaxial cable connector means 30 to be rigidly secured to lower support arm 14. In the preferred embodiment, coax connector means 30 is a conventional PL-259 connector adapted to threadably receive a conventional coax connector. Alignment of holes in the lower and upper support arms 14 and 12 respectively, provide a means for both securing antenna connection means 16 to the lower support arm 14 as well as providing a guide sleeve means for antenna 99 through the upper support arm 12. In this connection embodiment of the antenna 99 to the mounting apparatus 10, additional support is provided to the antenna 99 for resisting lateral forces thereon due to contact by the antenna with obstacles or obstructions such as tree branches, bridges or the like. Supporting the antenna shaft 99 along its vertical extent provides additional support by decreasing length of shaft 99 which is susceptible to vibrations. In this embodiment, the upper arm 12 acts as a pseudo shock absorber by providing a fixed point along the shaft vibration axis. Therefore, an improved antenna mounting structure is provided which provides additional rigidity and support for antennas mounted to vehicles and the like thereby preventing damage to such antennas.

Figure 6:
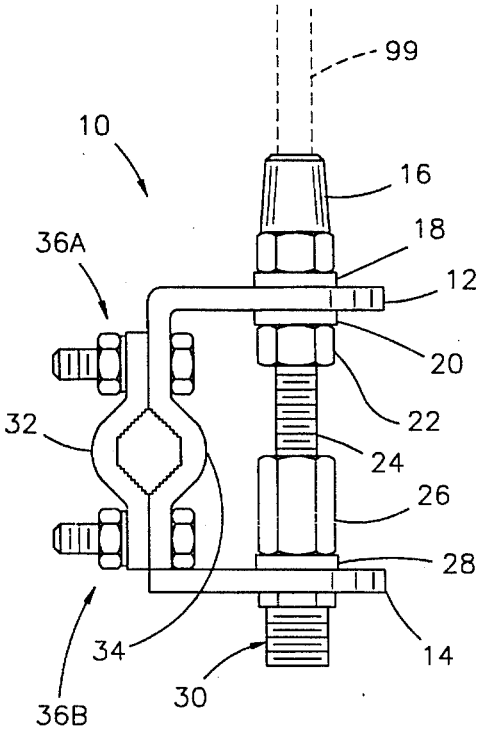
FIG. 6 is a side view of an embodiment wherein a nut is used to join the coax and mounting bolt.
Figure 7:
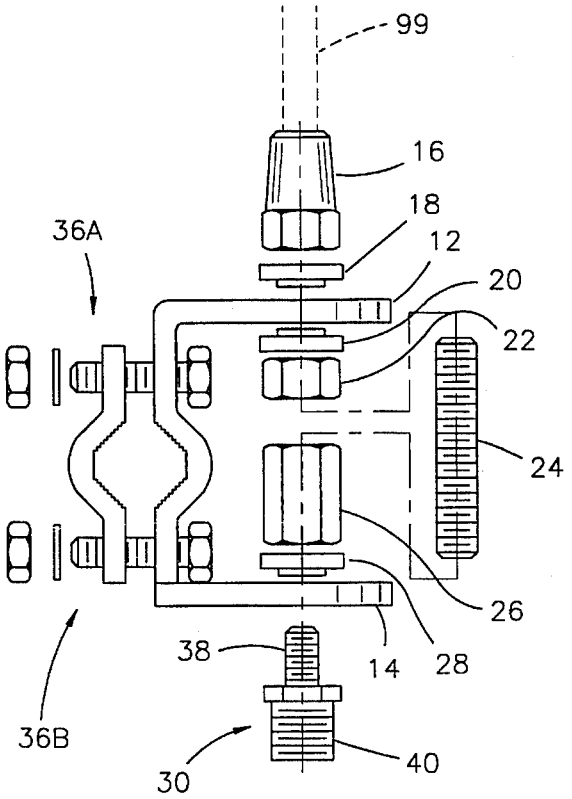
FIG. 7 is an exploded view of the embodiment illustrated in FIG. 6.
Figure 8:
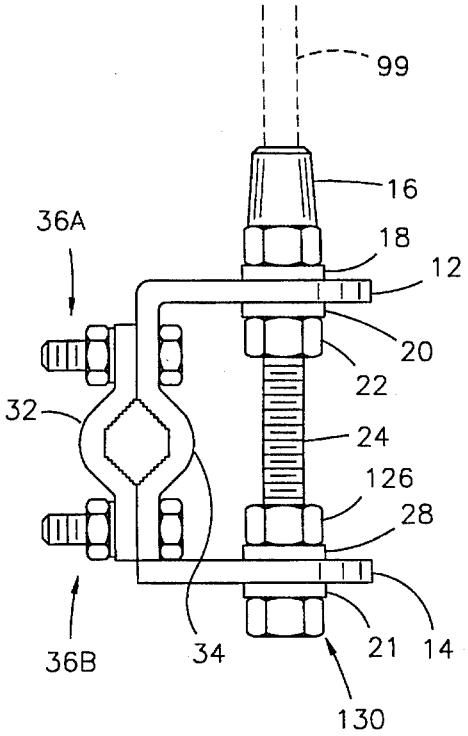
FIG. 8 is a side view of an embodiment wherein an extended bolt is used for mounting of the antenna and wherein connection to the coax cable is by a nut.
Figure 9:
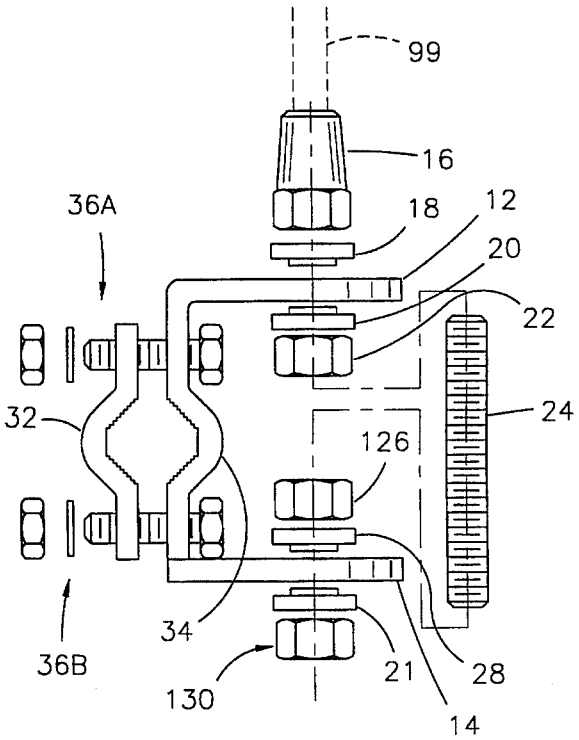
FIG. 9 is an exploded view of the embodiment illustrated in FIG. 8.

FIGS. 6 and 7 show a side and exploded side view respectively of an alternative embodiment of the present invention. shown in the these figures, the antenna 99 is secured by antenna connection means 16 to the upper arm 12 of mounting apparatus 10. In this embodiment, connection bolt 24 and nuts 22 and 26 form an inner connection means for connecting coaxial cable connector means 30 and antenna connection means 16. In the preferred situation, coaxial cable connector means 30 is a conventional PL-259 coax connector. In that case, the coax connector 30 would be threadably received within connection nut 26. It is also contemplated that connection means could comprise a conventional hex nut 130 as shown in FIGS. 8 and 9. In that case, inner connection bolt 24 would be of sufficient length to protrude through the hole in lower support arm 14 such that it is threadably engaged by nut 130. The inner coax cable conducting wire would then be secured to bolt 24 by nut 131. The outer coax ground wire would then be connected to either the mounting itself or some other portion of the vehicle such that an electrical connection is made between the ground wire and the vehicle, allowing the vehicle to function in its normal manner as a ground plane. If nut 130 is used instead of coax connector 30, it may be desirable to install an additional insulating member 21 (FIGS. 8 and 9) to prevent electrical contact of nut 130 and lower support arm 14. In the embodiment shown in FIGS. 6–9, inner connection bolt 24 is sufficient length to extend beyond upper support arm 12 such that it may be threadably received within antenna connection means 16. Interaction between connection means 16, bolt 24 and nut 22 is operative to tightly secure connection means 16 to upper support arm 12. Similarly, cooperative engagement of nut 26 with inner connection bolt 24 and coaxial connector means 30 or nut 130 is operative to secure connector 30 or nut 130 to the lower support arm 14. Thus a substantially rigid interconnection is made between the antenna connector 16, interconnecting bolt 24 and coax connector 30 or nut 130 (FIGS. 8, 9).

Figure 10:
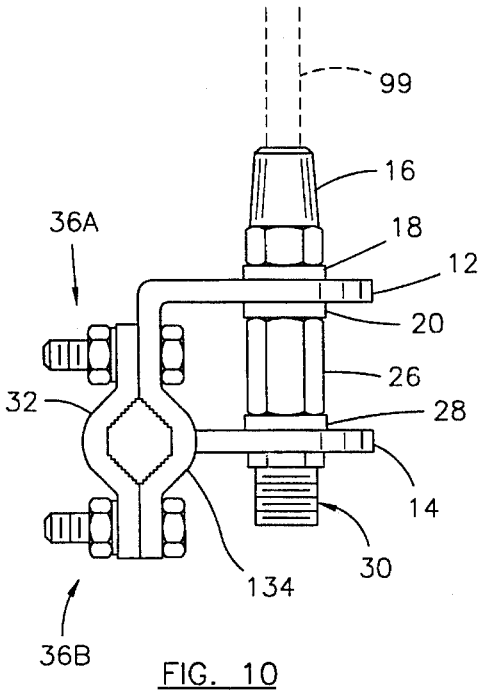
FIG. 10 is a side view of an embodiment having the narrower mounting brackets and using a coax connector.
Figure 11:
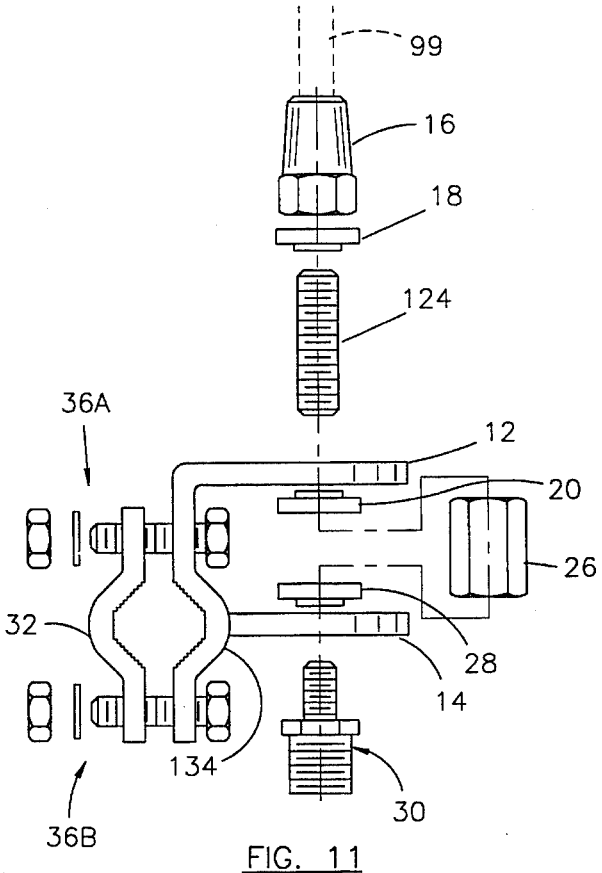
FIG. 11 is an exploded view of the embodiment of FIG. 10.

Yet another embodiment is illustrated in FIGS. 10 and 11 wherein upper and lower support arms 12 and 14 comprise a smaller vertical separation and wherein interconnection bolt 124 may be substantially shorter than that shown in FIGS. 6–9. As in the earlier embodiment, interconnection nut 26 is operative to threadably receive the coaxial cable connector means 30 and interconnection bolt 124 such that a substantially rigid connection is made between the coax connector cable means 30, the lower support arm 14, and the interconnection nut 26. Again, interconnection bolt 124 is of sufficient length to extend above upper securement arm 12 such that it may be threadably received within antenna connector means 16 thereby creating a substantially rigid connection between connector means 16, upper support arm 12 and nut 26. As with the earlier embodiments a nut (not shown) may be substituted for coax connector 30. As described above, the inner conductor cable would be connected to the bolt 124 and nut (not shown) and the ground cable connected to the mounting. Additionally, it may be desirable to insert an insulating member between the nut and the lower support arm 14.

Figure 12:
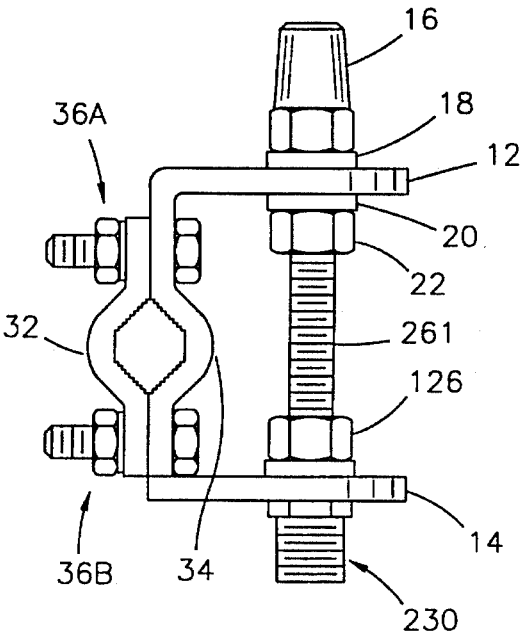
FIG. 12 is a side view of an embodiment having an extended coax mounting bolt.
Figure 13:
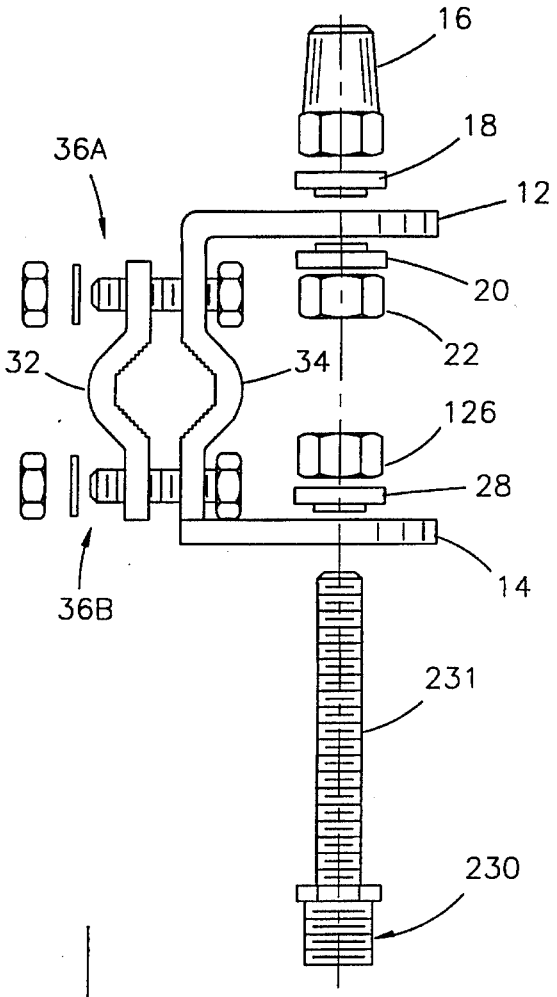
FIG. 13 is an exploded side view of the embodiment illustrated in FIG. 12.
Figure 14:
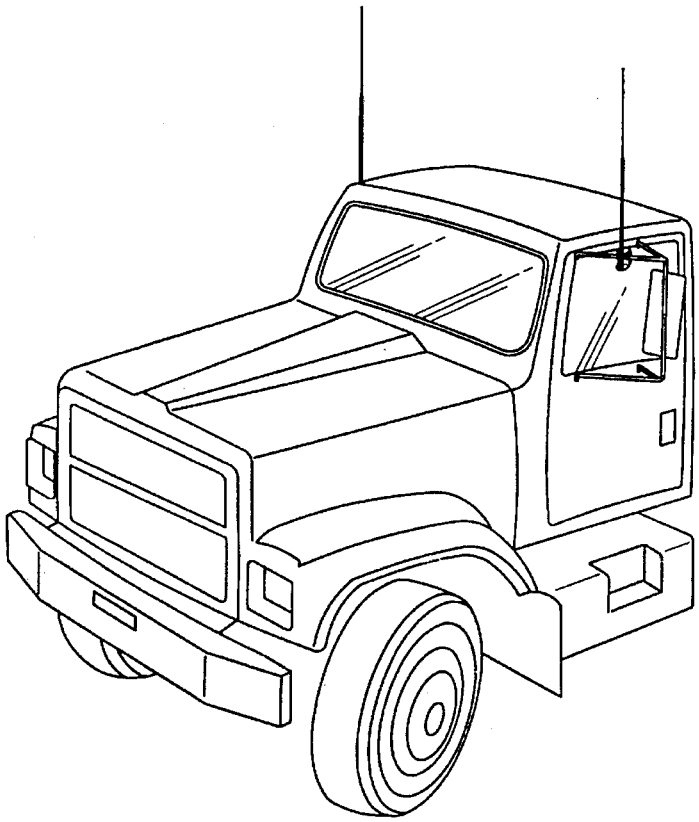
FIG. 14 is a view showing the installation of the antenna mount on a truck side mirror.

A final embodiment is illustrated in FIGS. 12 and 13 wherein an alternative coax connector means 230 is provided having an elongated mounting bolt 231 such that mounting bolt 231 is capable of extending between lower support arm 14 and through upper support arm 12 such that connector bolt 231 may be threadably received in antenna connector means 16. Thus, no additional interconnection bolt is required. Threaded engagement of bolt 231 by antenna connector means 16 in cooperation with nut 22 is operative to rigidly secure antenna connector means 16 to the upper support arm 12. Similarly, threaded engagement of connector bolt 231 by nut 126 is operative to secure coax connector means 230 to the lower support arm 14. Thus, a rigid interconnection is established between connector means 16, support arms 12 and 14 and coax connector 230. Interconnection bolt 231 is electrically insulated form upper and lower support arms 12 and 14 respectively by means of insulating members 18, 20 and 28.

It is obvious that numerous other modifications and variations of the present invention are possible in view of the above teaching. For example, the vertical spacing between the upper and lower support arms 12 and 14 may be varies to accommodate a particular application. Similarly, the first and second clamping members 32 and 34 may be of any variety of designs to accommodate the particular mounting structure upon which the antenna is to be mounted. Yet another modification might be the interconnection means between the antenna connector 16 and the coax connector 30.

Therefore, it is to be understood that the above description is intended in no way to limit the scope of protection of the claims and is representative of only one of several possible embodiments of the present invention.

There has thus been shown and described an invention which accomplishes at least all of the stated objectives.

I claim:

1. An improved antenna mounting apparatus for mounting an antenna to a rodlike mounting structure comprising:

an antenna mounting bracket including a pair of vertically spaced apart upper and lower arms having aligned holes therethrough and a base connected to and extending between said arms;

a clamp type mounting means for mounting said bracket to said rodlike mounting structure;

two O-ring shaped insulating members each adapted to be received in a respective one of said aligned holes in said arms;

antenna connection means adapted to engage said antenna and secure said antenna to said upper arm;

cable connection means secured to said lower arm for connecting an electrical cable to said apparatus; and interconnection means adapted to engage said antenna connection means and said cable connection means such that said antenna connection means, said interconnection means and said cable connection means all form a single structural unit extended through said aligned holes of said mounting bracket arms.

2. The antenna mounting apparatus of claim 1 wherein said mounting means comprises a plurality of clamping bolts and a complementary clamping member, said base and complementary clamping member each having a plurality of aligned holes adapted to receive said clamping bolts therethrough and wherein said base and said clamping members each have a generally V-shaped groove therein such that upon alignment of said plurality of holes, said V-shaped grooves oppose each other and are adapted to receive a mounting structure therebetween such that tightening of said clamping bolts causes said base and clamping member to tighten around said mounting structure forming a stable antenna mounting.

3. The antenna mounting apparatus of claim 1 wherein said cable connection means and said interconnection means comprise a single integral piece.

4. The antenna mounting apparatus of claim 3 wherein said cable connection means is a coaxial connector.

5. The antenna mounting apparatus of claim 3 wherein said cable connection means comprises a bolt and nut.

6. The antenna mounting apparatus of claim 1 wherein said interconnection means comprises a bolt having at least opposite ends threaded and adapted to threadably engage said cable connection means and said antenna connection means.

7. The antenna mounting apparatus of claim 1 wherein said cable connection means is a coaxial cable connector and wherein said interconnection means is a bolt having at least the opposite ends threaded and wherein said mounting apparatus further comprises a coupling member adapted to threadably engage said coaxial cable connector mounting post and said interconnection means bolt.

8. An improved antenna mounting apparatus for mounting an antenna having an elongated vertical shaft and a mounting base attached to one end thereof, to a rodlike mounting structure comprising:

an antenna mounting bracket including a pair of vertically spaced apart upper and lower arms having aligned holes therethrough and a base connected to and extending between said arms;

a clamp type mounting means for mounting said bracket to said rodlike mounting structure;

cable connection means for connecting an electrical cable to said apparatus;

two O-ring shaped insulating members each adapted to be received in a respective one of said aligned holes in said arms; and antenna connection means adapted to engage said antenna and cable connection means and secure said antenna and cable connection means to said lower spaced apart arm, such that said antenna vertical shaft extends upward through said upper arm aligned hole, said upper arm hole thus functioning as a guide sleeve for said antenna shaft.

9. The antenna mounting apparatus of claim 8 wherein said mounting means comprises a plurality of clamping bolts and a complementary clamping member, said base and complementary clamping member each having a plurality of aligned holes adapted to receive said clamping bolts therethrough and wherein said base and said clamping members each have a generally V-shaped groove therein such that upon alignment of said plurality of holes, said V-shaped grooves oppose each other and are adapted to receive a mounting structure therebetween such that tightening of said clamping bolts causes said base and clamping member to tighten around said mounting structure forming a stable antenna mounting.

10. The antenna mounting apparatus of claim 8 wherein said cable connection means is a coaxial connector.

11. The antenna mounting apparatus of claim 8 wherein said cable connection means comprises a bolt and nut.

12. An improved antenna mounting apparatus for mounting an antenna to a mounting structure comprising:

an antenna mounting bracket including a pair of vertically spaced apart arms having aligned holes therethrough and a base connected to and extending between said arms;

mounting means for mounting said bracket to said mounting structure, said mounting means including a plate adapted to be placed in spaced relation to said mounting bracket base and adapted to receive said mounting structure therebetween and means for releasably clamping said plate and base together to frictionally engage said mounting structure therebetween;

two O-ring shaped insulating members each adapted to be received in a respective one of said aligned holes in said arms;

antenna connection means adapted to engage said antenna and secure said antenna to one of said spaced apart arms;

cable connection means for connecting an electrical able to said apparatus; and interconnection means adapted to engage said antenna connection means and said cable connection means such that said antenna connection means, said interconnection means and said cable connection means all form a single structural unit extended through said aligned holes of said mounting bracket arms.

* * * * *